US009281583B2

(12) United States Patent
Yuan et al.

(10) Patent No.: US 9,281,583 B2
(45) Date of Patent: Mar. 8, 2016

(54) ELECTRICAL CONNECTOR HAVING IMPROVED INSULATIVE HOUSING

(71) Applicant: HON HAI PRECISION INDUSTRY CO., LTD., New Taipei (TW)

(72) Inventors: Wei Yuan, Shenzhen (CN); Yu-San Hsiao, New Taipei (TW); Shih-Wei Hsiao, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/252,798

(22) Filed: Apr. 15, 2014

(65) Prior Publication Data

US 2014/0308826 A1 Oct. 16, 2014

(30) Foreign Application Priority Data

Apr. 15, 2013 (CN) ..... 2013 1 01290488

(51) Int. Cl.

| | |
|---|---|
| ***H01R 12/00*** | (2006.01) |
| ***H01R 12/71*** | (2011.01) |
| ***H01R 24/58*** | (2011.01) |
| ***H01R 12/72*** | (2011.01) |
| ***H01R 12/73*** | (2011.01) |

(52) U.S. Cl.

CPC ..... *H01R 12/71* (2013.01); *H01R 12/722* (2013.01); *H01R 12/732* (2013.01); *H01R 24/58* (2013.01)

(58) Field of Classification Search

CPC .... H01R 12/71; H01R 12/732; H01R 12/722; H01R 24/58

USPC ..... 439/79, 607.23, 607.4, 607.36

See application file for complete search history.

(56) References Cited

U.S. PATENT DOCUMENTS

| | | | | |
|---|---|---|---|---|
| 6,619,984 | B2 * | 9/2003 | Liu | H01R 13/6594 439/607.4 |
| 6,932,646 | B2 * | 8/2005 | Sloey | H01R 13/6581 439/607.4 |
| 7,192,297 | B1 * | 3/2007 | Wu | H01R 12/592 439/353 |
| 7,497,709 | B1 * | 3/2009 | Zhang | H01R 12/7094 200/51.09 |
| 7,510,406 | B2 * | 3/2009 | Dong | H01R 12/7011 439/79 |
| 7,651,343 | B2 * | 1/2010 | Zhu | H01R 12/7047 439/569 |
| 7,670,151 | B2 * | 3/2010 | Yang | H01R 12/7052 439/378 |
| 7,686,628 | B2 * | 3/2010 | Lino | H01R 43/0256 439/108 |
| 7,726,983 | B2 * | 6/2010 | Zhu | H01R 12/57 439/552 |
| 7,914,302 | B1 * | 3/2011 | Zhu | H01R 13/41 439/79 |
| 7,946,887 | B1 * | 5/2011 | Zhang | H01R 27/02 439/607.23 |

(Continued)

*Primary Examiner* — Abdullah Riyami
*Assistant Examiner* — Nader J Alhawamdeh
(74) *Attorney, Agent, or Firm* — Wei Te Chung; Ming Chieh Chang

(57) ABSTRACT

An electrical connector includes a first insulative housing having a first mating port and a second mating port arranged side by side, a plurality of first contacts retained to the first mating port, and a plurality of second contacts retained to the second mating port. The first mating port includes first and second mating tongues providing corresponding first and second mating faces opposite to each other. The second mating port defines a first strengthen arm adjacent to the first mating port to connect with the first and second mating tongues, the first contacts provide first contacting portions exposed upon both the first mating face and the second mating face.

20 Claims, 10 Drawing Sheets

(56) References Cited

U.S. PATENT DOCUMENTS 7,963,800 B1 * 6/2011 Chen ..... H01R 12/7047 439/607.27
7,985,080 B2 * 7/2011 Ai ..... H01R 12/712 439/570
7,993,161 B2 * 8/2011 Mao ..... H01R 12/7052 439/607.4
8,002,588 B1 * 8/2011 Zhu ..... H01R 12/716 439/660
8,007,289 B2 * 8/2011 Bandhu ..... H01R 13/6271 439/638
8,011,966 B1 * 9/2011 Tang ..... H01R 13/6461 439/638
8,727,796 B2 * 5/2014 Ngo ..... H01R 12/75 439/660
2007/0149006 A1 * 6/2007 Wu ..... H01R 12/721 439/78
2008/0003862 A1 * 1/2008 Yuan ..... H01R 12/716 439/350
2008/0176426 A1 * 7/2008 Zhu ..... H01R 12/721 439/79
2010/0035477 A1 * 2/2010 Yuan ..... H01R 12/79 439/638
2010/0317229 A1 * 12/2010 Chen ..... H01R 27/02 439/607.23
2011/0053416 A1 * 3/2011 Chen ..... H01R 13/6581 439/607.01
2011/0143597 A1 * 6/2011 Lee ..... H01R 12/7023 439/630
2011/0165788 A1 * 7/2011 Tagawa ..... H01R 12/88 439/345
2011/0165790 A1 * 7/2011 Tagawa ..... H01R 12/79 439/374
2011/0263162 A1 * 10/2011 Zhu ..... H01R 12/57 439/660
2012/0077389 A1 * 3/2012 Zhang ..... H01R 24/60 439/660
2012/0108109 A1 * 5/2012 Zhang ..... H01R 12/721 439/629

* cited by examiner

ELECTRICAL CONNECTOR HAVING IMPROVED INSULATIVE HOUSING

BACKGROUND OF THE INVENTION

1. Field of the Invention

The present invention relates to an electrical connector, and more particular to a complex electrical connector having improve insulative housing for improving the rigidity thereof and further an additional mounting bracket for securing to a printed circuit board.

2. Description of the Related Art

U.S. Pat. No. 7,946,887 issued on May 24, 2011 discloses an electrical connector assembly including a first connector and a second connector mating with each other. The first connector includes a longitudinal base and a plurality of contacts retained in the base. The base defines a mating tongue and a mating frame arranged side by side along the longitudinal direction, and a mating cavity is surrounded by the mating frame. The plurality of contacts are divided into a first contact set exposed upon a mating face of the mating tongue and a second contact set projecting into the mating cavity. The first connector has two connector interfaces arranged side by side which provides a complex connector benefit for miniaturization. However, the mating tongue is spaced from the mating frame with a gap provided therebetween, and the longitudinal base will be easily snapped in a portion corresponding to the gap. Moreover, the first contact set is arranged upon a single mating tongue, which is not benefit for excellent high-frequency characteristics.

Therefore, a new design is required.

SUMMARY OF THE INVENTION

Accordingly, an object of the present invention is to provide an electrical connector having an improved insulative housing suitable for improving the rigidity.

In order to achieve the object set forth, an electrical connector includes a first insulative housing having a first mating port and a second mating port arranged side by side along a longitudinal direction, a first contact set including a plurality of first contacts retained to the first mating port; and a second contact set including a plurality of second contacts retained to the second mating port. The first mating port includes first and second mating tongues projecting along a front-to-rear direction perpendicular to the longitudinal direction and stacked in a vertical direction perpendicular to both the longitudinal direction and the front-to-rear direction, the first and second mating tongues provide corresponding first and second mating faces opposite to each other in the vertical direction. The second mating port defines a first strengthen arm adjacent to the first mating port to connect with one end of the first mating tongue and one end of the second mating tongue, the first contacts provide first contacting portions exposed upon both the first mating face and the second mating face.

Other objects, advantages and novel features of the invention will become more apparent from the following detailed description of the present embodiment when taken in conjunction with the accompanying drawings.

DETAILED DESCRIPTION OF THE INVENTION

Figure 1:
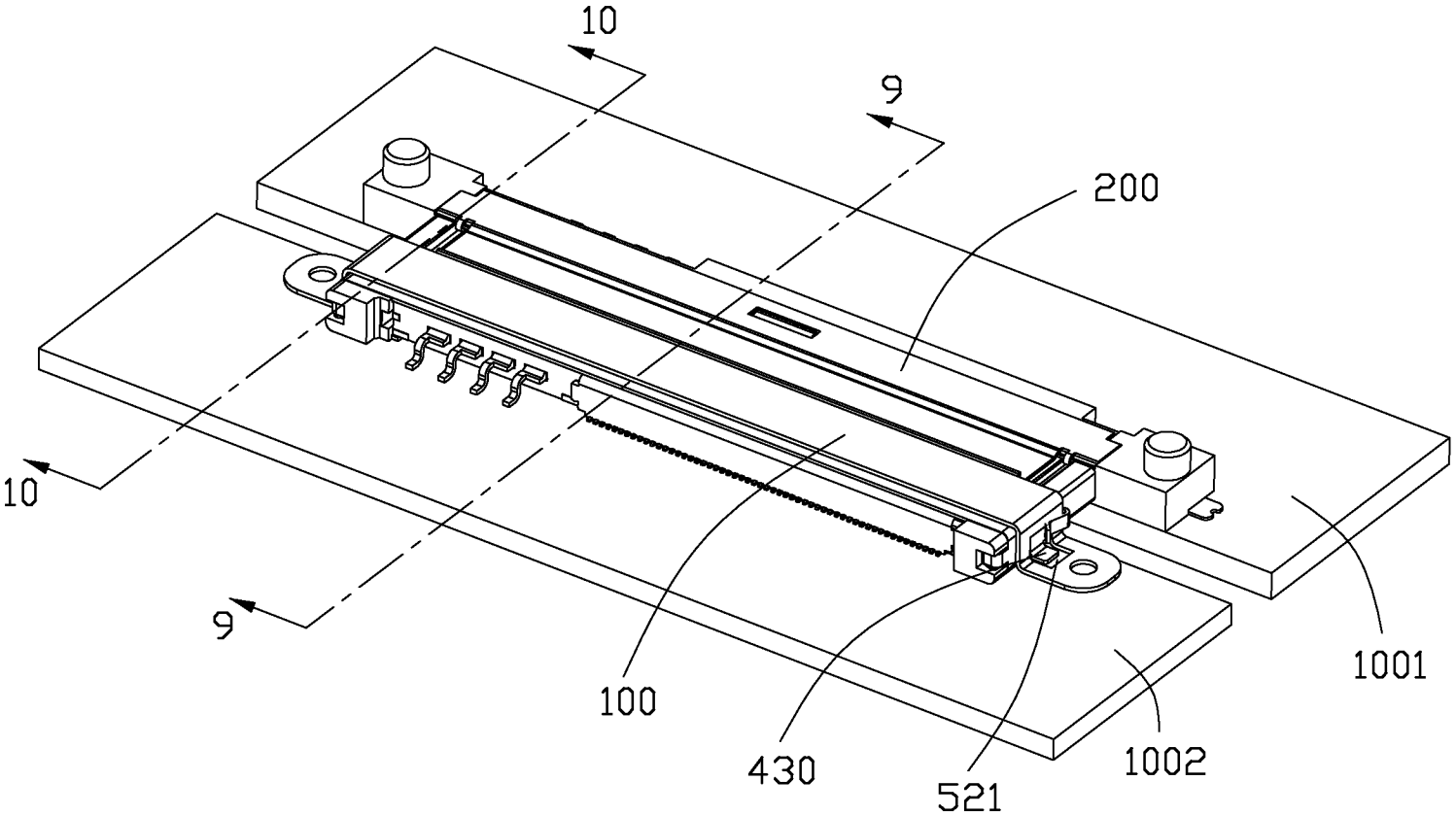
FIG. 1 is an assembled, perspective view of an electrical connector assembly including an electrical connector and a mating connector in accordance with the present invention.
Figure 2:
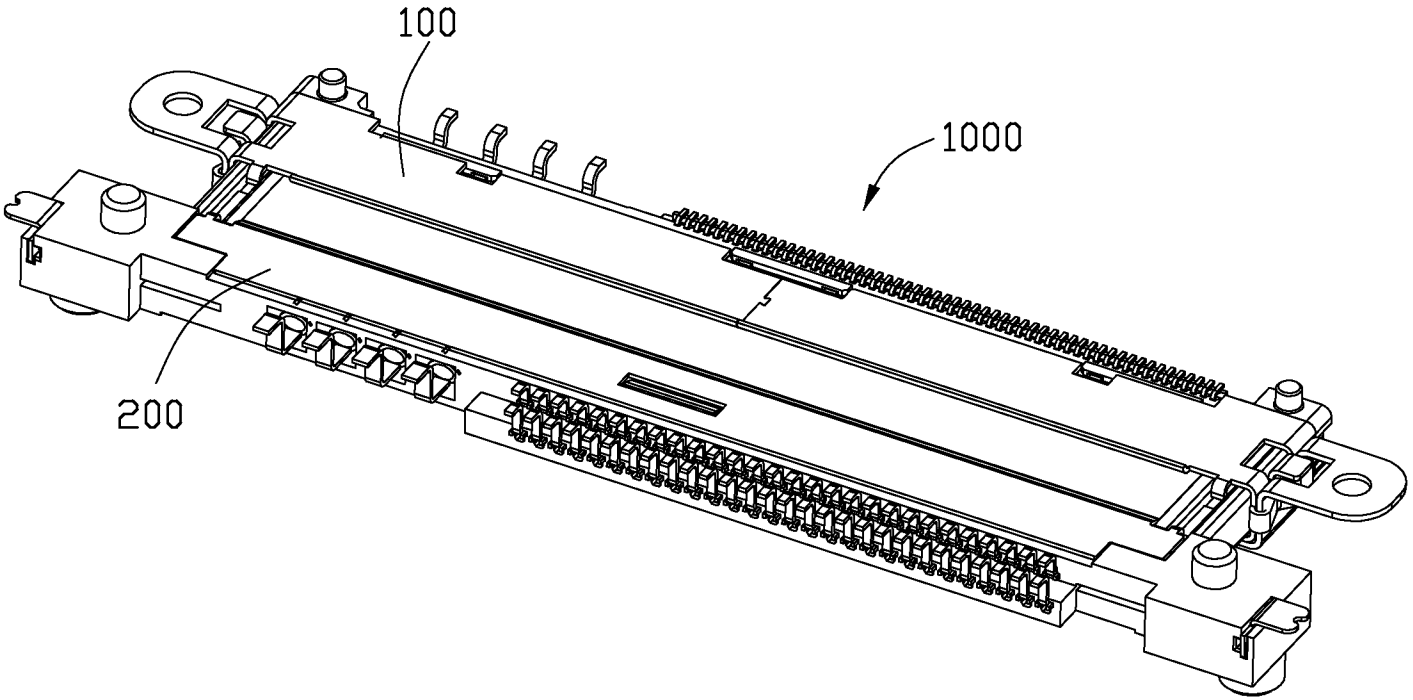
FIG. 2 is another assembled, perspective view of the electrical connector assembly shown in FIG. 1.

Reference will now be made to the drawing figures to describe a preferred embodiment of the present invention in detail. Referring to FIG. 1 and FIG. 2, an electrical connector assembly 1000 in accordance with the present invention includes an electrical connector 100, or a first connector, to be mounted onto a first printed circuit board 1002, and a mating connector 200, or a second connector, to be mounted onto a second printed circuit board 1001 for mating with the electrical connector 100.

Figure 3:
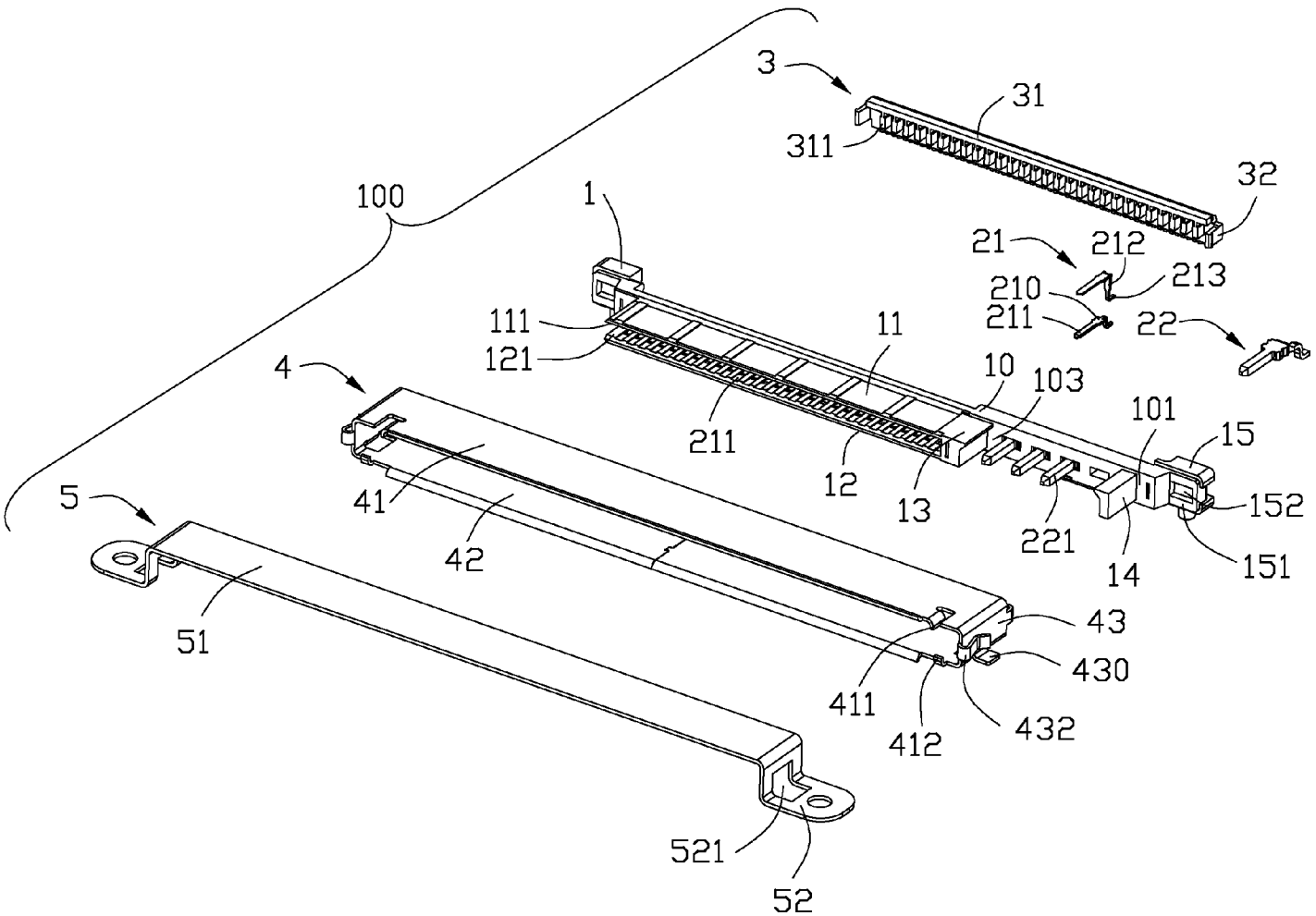
FIG. 3 is a partly exploded perspective view of the electrical connector shown in FIG. 1.
Figure 4:
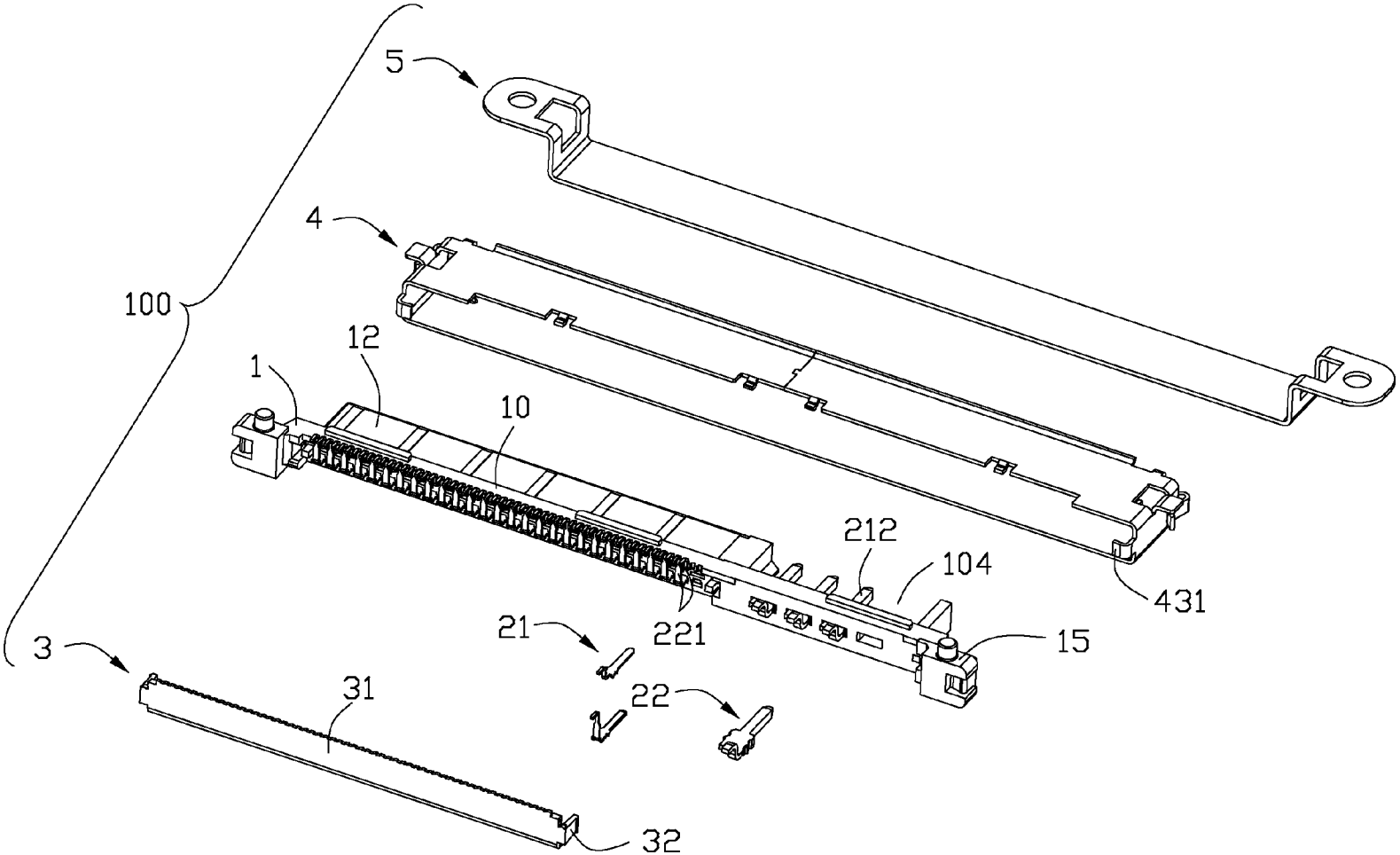
FIG. 4 is another partly exploded perspective view of the electrical connector shown in FIG. 3.
Figure 5:
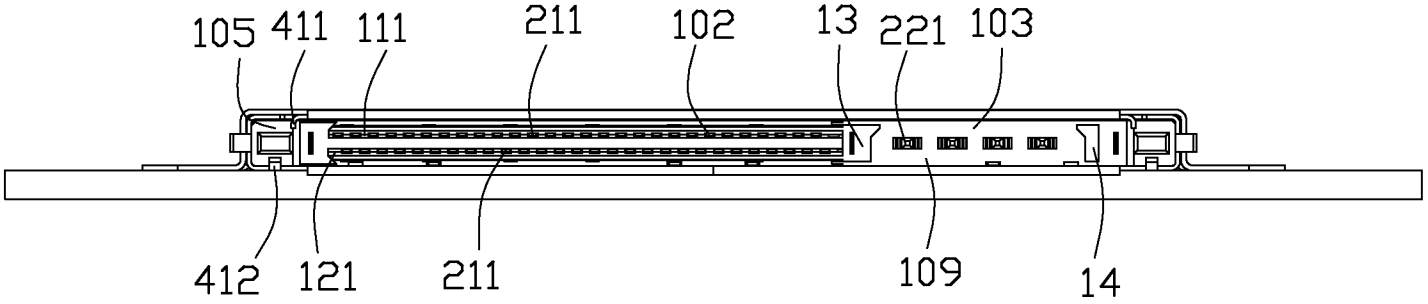
FIG. 5 is a front elevational view of the electrical connector shown in FIG. 1.

Referring to FIG. 3 to FIG. 5, the electrical connector 100 includes an insulative first housing 1, a plurality of contacts arranged in the first housing 1, a spacer 3 retained to the first housing 1, a metal shell 4 enclosing the first housing 1, and a retaining member 5 attached to the metal shell 4.

The first housing 1 defines a longitudinal base portion 10, a first and a second mating tongue 11, 12 extending forwardly from the base portion 10 along a front-to-rear direction and stacked with each other in a vertical direction perpendicular to both the longitudinal direction and the front-to-rear direction, a first and a second strengthen arm 13, 14 projecting forwardly from the base portion 10 along the front-to-rear direction, and a pair of fixing portions 15 extending outwardly from two opposite ends of the base portion 10 along the longitudinal direction. The first and second mating tongues 11, 12 space from each other and provide opposite first and second mating faces 111, 121 facing to each other. The first and second strengthen arms 13, 14 space from each other and locate at a same side of the first and second mating tongues 11, 12, the first strengthen arm 13 integrally connect with both an end of the first mating tongue 11 and an end of the second mating tongue 12. The first and second mating tongues 11, 12 and the first and second strengthen arms 13, 14 extend from a front face 101 of the base portion 10. The fixing portions 15 extend from a rear face of the base portion 10, and each fixing portion 15 defines a stopping face 151 facing forwards and a receiving room 152 recessed rearwards from the stopping face 151 along the front-to-rear direction, the stopping face 151 is located behind the front face 101 in the front-to-rear direction.

The plurality of contacts are divided into a first contact set and a second contact set, each first contact 21 of the first contact set defines a first retaining portion 210, a stiff first contacting portion 211 extending forwards from the first retaining portion 210, a connecting portion 212 bending downwardly from a rear end of the first retaining portion 210, and a surface mounting type first soldering portion 213 extending from the connecting portion 212. The first contact set is arranged in the first housing 1 along the longitudinal direction with the first contacting portions 211 exposed upon both the first mating face 111 and the second mating face 121, and as best shown in FIG. 5, the first contacting portions 211 exposed upon the first mating face 111 are offset with that exposed upon the second mating face 121 in the longitudinal direction. The first contacts 21 of the first contact set extend out of the first housing 1 with the connecting portions 212 located in two rows and the first soldering portions 213 arranged in one row along the longitudinal direction. The second contacts 22 of the second contact set are arranged in the first housing 1 along the longitudinal direction with second contacting portions 221 disposed between the first and second strengthen arms 13, 14, second soldering portions of the second contact set extend out of the first housing 1.

The spacer 3 defines a main body portion 31 and a pair of latching arms 32 respectively disposed at two ends of the main body portion 31 and extending forwardly from the main body portion 31. The main body portion 31 provides a plurality of spaced partitions 311 in an inner surface thereof. The spacer 3 is assembled to a rear portion of the base portion 10 and to be retained behind the first and second tongue portion 11, 12 by the latching arms 32, each connecting portion 212 disposed in a rear row is disposed between two adjacent partitions 311. The spacer 3 is set for preventing the first contact set from dropping out rearwards and improving crosstalk between the connecting portions 212.

The metal shell 4 includes a first side wall 41, a second side wall 42 opposite to the first side wall 41, and a pair of end walls 43 connecting the first and second side walls 41, 42 at two ends thereof. A pair of first guiding portions 411 is ripped from the first side wall 41 at a portion adjacent to the end walls 43 and projects to the second side wall 42. A pair of second guiding portions 412 bends upwards from a front edge of the second side wall 42 at a portion adjacent to the end walls 43. The first and second guiding portions 411, 412 offset in the longitudinal direction and respectively disposed in two perpendiculars planar. The metal shell 4 is retained to the first housing 1 by the latching portions 431 locking to the fixing portion 15.

The retaining member 5 for retaining the electrical connector 100 in the first printed circuit board 1002 includes a board portion 51 and a pair of soldering legs or mounting ears 52 bending downwardly from two opposite ends thereof, each soldering leg 52 defines a through hole 521 thereof. The retaining member 5 is assembled to the metal shell 4 and clipped by resilient arms 432 of the metal shell 4, the board portion 51 attaches to the first side wall 41. Each soldering leg 52 is disposed outside of the end walls 43 with the connecting legs or soldering pads 430 of the end walls 43 disposed in the through hole 521.

Referring to FIG. 5, the metal shell 4 encloses the first housing 1 with the base portion 10, the first and second mating tongues 11, 12, the first and second strengthen arms 13, 14 and the fixing portions 15 disposed in a mating cavity 109. The first and second mating tongues 11, 12 are disposed in the mating cavity 109 to provide a first mating port 102, and the first and second strengthen arms 13, 14 are disposed in the mating cavity 109 to provide a second mating port 103 therebetween. The second mating port 103 defines a mating room 104 disposed between the first and second strengthen arms 13, 14, and the second contacting portions 221 project into the mating room 104. The first strengthen arm 13 integrally connect with both an end of the first mating tongue 11 and an end of the second mating tongue 12 to connect the first and second mating ports 102, 103, which can improve the rigidity of the electrical connector 100. A guiding room 105 is provided in front of each fixing portion 15, and the first guiding portions 411 project into the guiding room 105.

Figure 6:
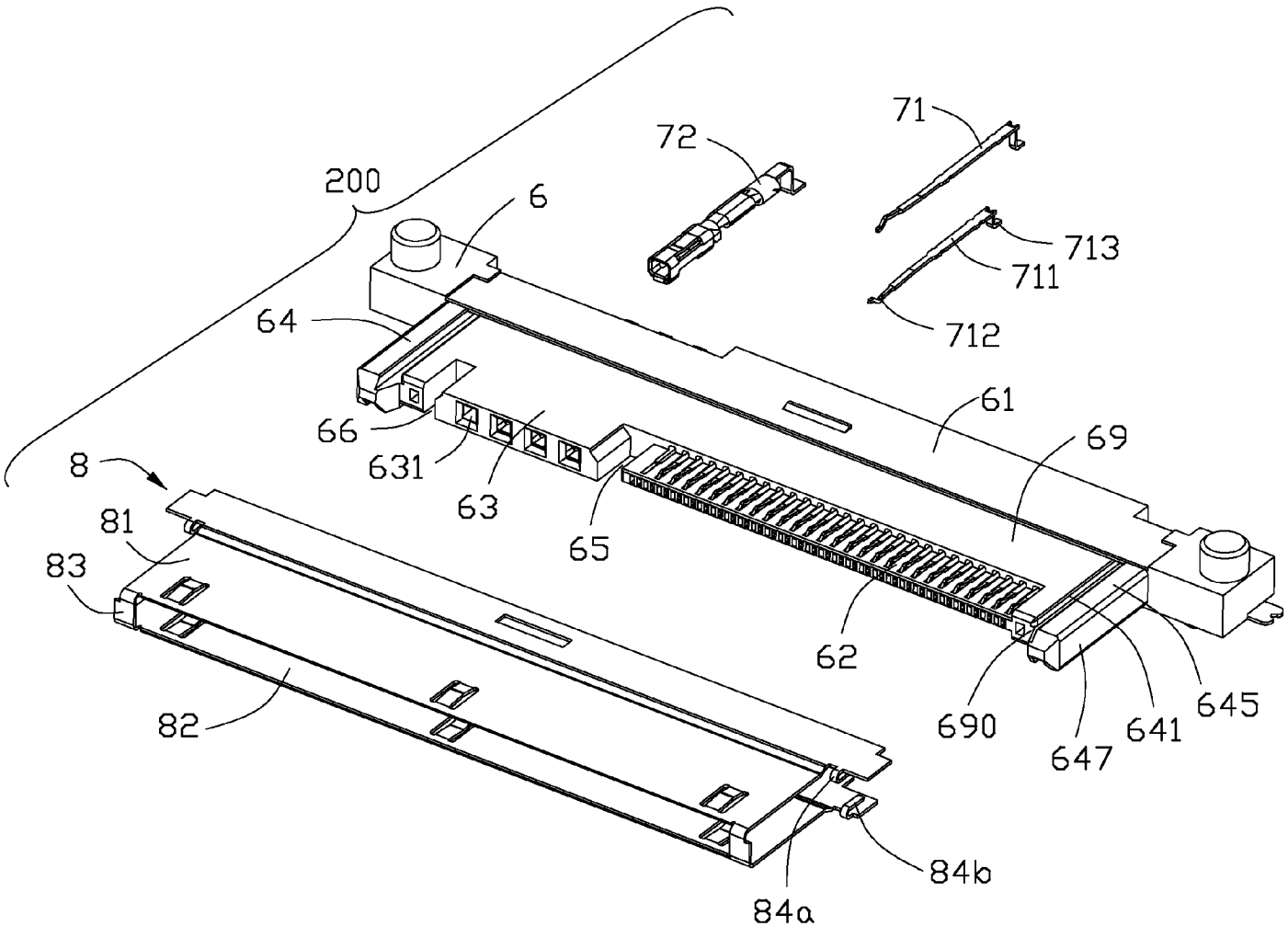
FIG. 6 is a partly exploded view of the mating connector shown in FIG. 1.
Figure 7:
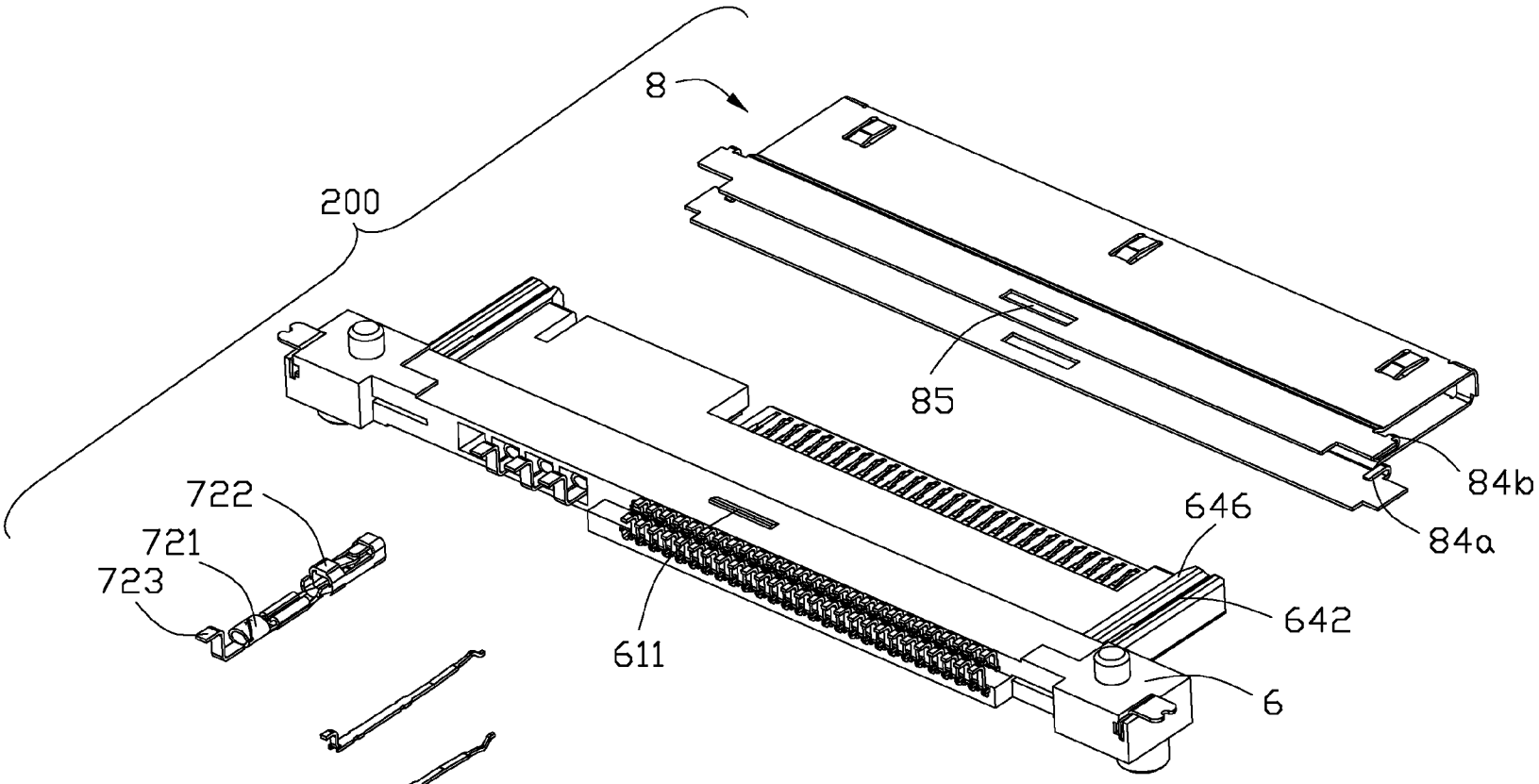
FIG. 7 is another partly exploded view of the mating connector shown in FIG. 6.
Figure 8:
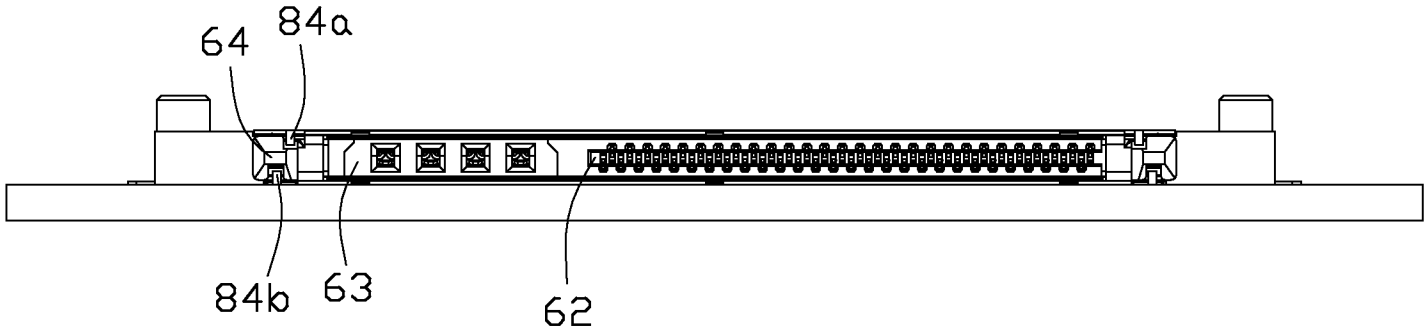
FIG. 8 is a front elevational view of the mating connector shown in FIG. 1.

Referring to FIG. 6 to FIG. 8, the mating connector 200 includes a second insulative housing 6, a plurality of mating contacts retained to the second housing 6, and a mating shell 8 attached to the second housing 6.

The second housing 6 defines a second base portion 61, a third mating port 69 extending forwards from the second base portion 61, and a pair of guiding posts 64 disposed at two opposite sides of the third mating port 69. The third mating portion 69 defines a front face 690 facing forwards, the guiding posts 64 forwardly project beyond the front face 690. Each guiding post 64 defines an upper face 645, a lower face 646 opposite to the upper face 645, and an outer connecting face 647 connecting the upper face 645 and the lower face 646. The third mating port 69 includes a first mating potion 62 and a second mating portion 63 arranged side by side in the longitudinal direction. A first receiving slot 65 is provided between the first mating potion 62 and the second mating portion 63, a second receiving slot 66 is provided adjacent to the second mating portion 63. Each guiding post 64 defines a first guiding slot 641 in the upper face 645 and a second guiding slot 642 in the lower face 646, the first and second guiding slots 641, 642 both extend in the front-to-rear direction and offset with each other in the longitudinal direction. A plurality of receiving grooves arrange in two opposite longitudinal faces of the first mating portion 62, the second mating portion 63 defines a plurality of terminal holes 631 therein.

The mating contacts include a plurality of first mating contacts 71 and a plurality of second mating contacts 72. Each first mating contact 71 defines a stiff first securing portion 711, a resilient contacting arm 712 extending forwards from the first securing portion 711, and a first connecting end 713 extending from a rear portion of the first securing portion 711. Each second mating contact 72 defines a second securing portion 721, a clipping portion 722 extending forwardly from a front end of the second securing portion 721, and a second connecting end 723 extending from a rear portion of the second securing portion 721. The first mating contacts 71 arrange in two rows to be retained in the second base portion 61, the resilient contacting arms 712 are received in the receiving grooves to expose upon two opposite longitudinal faces of the first mating portion 62, the first connecting ends 713 extend out of the second base portion 61 to arrange in two rows. The second mating contacts 72 are retained in the second base portion 61 with the clipping portions 722 received in the terminal holes 631, the second connecting ends 723 extend out of the second base portion 61 and arrange in one row.

The mating shell 8 includes opposite first and second base plates 81, 82, and two connecting plates 83 connecting the front edges of the first and second base plates 81, 82 at two side portions thereof. The first and second base plates 81, 82 provide opposite first and second locking portions **84*a*, 84*b* which offset with each other in the longitudinal direction. The mating shell 8 are rearwards assembled to the second housing 6, the first locking portion 84*a* slides in the first guiding slot 641 and the second locking portion 84*b* slides in the second guiding slot 642 until the first and second locking portions 84*a*, 84*b* latching with the second housing 6, which can guide the mating shell 8 assembled to the second housing 6 smoothly. The latching holes 85 disposed in the first and second base plates 81, 82 latch with the protrusions 611 to improve the retaining between the mating shell 8 and the second housing 6**.

Figure 9:
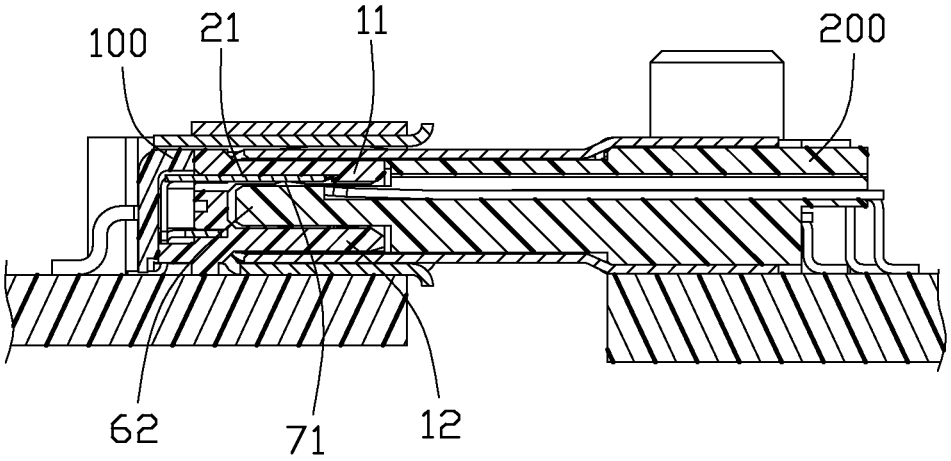
FIG. 9 is a cross-section view of the electrical connector assembly taken along line 9-9 of FIG. 1.
Figure 10:
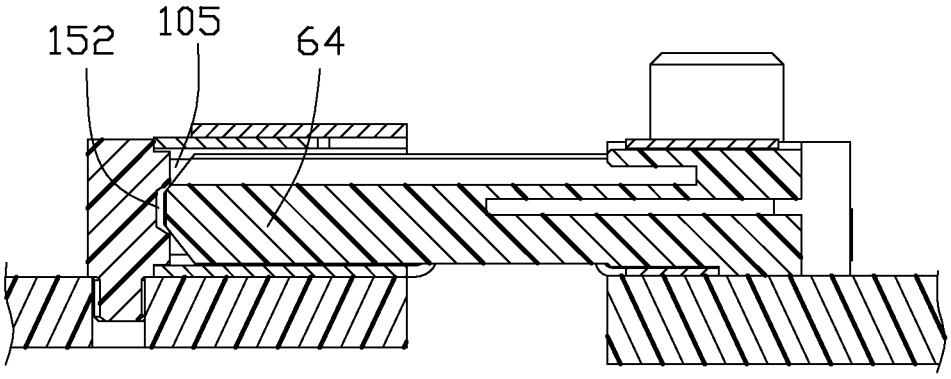
FIG. 10 is a cross-section view of the electrical connector assembly taken along line 10-10 of FIG. 1.

Referring to FIG. 9 and FIG. 10, when the electrical connector 100 mates with the mating connector 200, each first guiding portion 411 is received in a corresponding first guiding slot 641 and slides in the first guiding slot 641, and each second guiding portion 412 is received in a corresponding second guiding slot 642 and slides in the second guiding slot 642, the first mating potion 62 is disposed between the first mating tongue 11 and the second mating tongue 12 to make the first contacts 21 mechanically and electrically contact with the first mating contacts 71. The second mating portion 63 extends into the mating room 104 to make the second contacting portions 221 project into the terminal holes 631 to be clipped by the clipping portions 722. The first strengthen arm 13 is received in the first receiving slot 65, and the second strengthen arm 14 is received in the second receiving slot 66. The guiding posts 64 each is received in a corresponding guiding room 105 with a free end projects into the receiving room 152.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a first insulative housing having a first mating port and a second mating port arranged side by side along a longitudinal direction, the first mating port including first and second mating tongues projecting along a front-to-rear direction perpendicular to the longitudinal direction and stacked in a vertical direction perpendicular to both the longitudinal direction and the front-to-rear direction, the first and second mating tongues providing corresponding first and second mating faces opposite to each other in the vertical direction;

a first contact set including a plurality of first contacts retained to the first mating port; and a second contact set including a plurality of second contacts retained to the second mating port;

wherein the second mating port defines a first strengthen arm adjacent to the first mating port to connect with one end of the first mating tongue and one end of the second mating tongue, the first contacts provide first contacting portions exposed upon both the first mating face and the second mating face; wherein the other end of the first mating tongue and the other end of the second mating tongue are communicatively spaced from each other without connection therebetween in the vertical direction.

2. The electrical connector as described in claim 1, wherein the second mating port defines a second strengthen arm spaced from the first strengthen arm, and a mating room is disposed between the first and second strengthen arms, the first strengthen arm integrally connect with the first mating tongue and the second mating tongue.

3. The electrical connector as described in claim 2, further comprising a metal shell enclosing the first housing, the metal shell surrounds the first and second mating ports to dispose the first and second mating ports in a mating cavity.

4. The electrical connector as described in claim 1, further comprising a metal shell enclosing the first housing, the first housing defines a pair of fixing portions extending outwardly from two opposite ends thereof along the longitudinal direction, and a guiding room is provided in front of each fixing portion.

5. The electrical connector as described in claim 4, wherein the metal shell defines first and second side walls opposite to each other, and a first guiding portion is ripped from the first side wall and projects to the second side wall, a second guiding portion bends upwards from a front edge of the second side wall, the first and second guiding portions offset in the longitudinal direction and respectively disposed in two perpendiculars planar.

6. The electrical connector as described in claim 3, further comprising a retaining member attached to the metal shell, the retaining member defines through holes thereof for receiving the connecting legs of the metal shell therein.

7. The electrical connector as described in claim 1, wherein the first contacting portions exposed upon the first mating face are offset with that exposed upon the second mating face in the longitudinal direction.

8. An electrical connector assembly including an electrical connector and a mating connector mated with each other, the electrical connector comprising:

a first insulative housing having a longitudinal base portion, first and second mating tongues projecting forwards along a front-to-rear direction and stacked in a vertical direction perpendicular to the front-to-rear direction, and a first strengthen arm extending forwards from the base portion, the first and second mating tongues providing corresponding first and second mating faces opposite to each other in the vertical direction;

a plurality of first and second contacts retained to the first housing and respectively disposed at two sides of the first strengthen arm; and a metal shell enclosing the first housing and forming a pair of guiding portions around a front edge thereof;

the mating connector comprising:

a second insulative housing having a first mating portion and a second mating portion arranged side by side along a longitudinal direction, a first receiving slot disposed between the first and second mating portions, and a pair of guiding slots formed in an exterior surface thereof;

a plurality first mating contacts exposed upon two opposite longitudinal face of the first mating portion; and a plurality of second mating contacts received in the second mating portion;

a metallic mating shell enclosing the second housing and forming a pair of locking portions received within the pair of guiding slots;

wherein the first strengthen arm integrally connects with one end of the first mating tongue and one end of the second mating tongue, the first contacts provide first contacting portions exposed upon both the first mating face and the second mating face; when the electrical connector mates with the mating connector, the first mating portion is disposed between the first mating tongue and the second mating tongue to make the first contacts mechanically and electrically contact with the first mating contacts, the second contacts project into the second mating portion to be clipped by the second mating contacts, and the first strengthen arm is received in the first receiving slot; wherein during mating, the pair of guiding portions are received within the pair of guiding slots, respectively.

9. The electrical connector assembly as described in claim 8, wherein the first housing defines a pair of fixing portions extending outwardly from two opposite ends thereof along the longitudinal direction, the metal shell encloses the fixing portions to provide a guiding room in front of each fixing portion.

10. The electrical connector assembly as described in claim 9, wherein the first mating portion combines with the second mating portion to define a third mating port, and the mating connector provides a pair of guiding posts respectively disposed at two ends of the third mating port to be received in the guiding rooms.

11. The electrical connector assembly as described in claim 10, wherein the metal shell defines first and second side walls opposite to each other, and a first guiding portion is ripped from the first side wall and projects to the second side wall, a second guiding portion bends upwards from a front edge of the second side wall, the first and second guiding portions offset in the longitudinal direction and respectively disposed in two perpendiculars planar.

12. The electrical connector assembly as described in claim 11, wherein each guiding post defines a first guiding slot in an upper face and a second guiding slot in a lower face, the first and second guiding slots both extend in the front-to-rear direction and offset with each other in the longitudinal direction, the first guiding portion is received in and slides in the first guiding slot, and the second guiding portion is received in and slides in the second guiding slot.

13. An electrical connector assembly comprising:

a printed circuit board;

an electrical connector mounted upon the printed circuit board and including:

an insulative housing extending along a longitudinal direction and including a pair of opposite mating tongues commonly defining a gap therebetween in a vertical direction perpendicular to said longitudinal direction for receiving a mating blade of a complementary connector inserted in a front-to-back direction perpendicular to both said vertical direction and said longitudinal direction;

two rows of contacts disposed in the housing with contacting sections exposed upon both said mating tongues facing the gap toward each other;

a metallic shell assembled to and enclosing the housing circumferentially except the front-to-back direction to define a mating port thereof;

a metallic retaining member seated upon the shell and including two opposite upside-down L-shaped mounting ears, at two opposite longitudinal ends, fastened to the printed circuit board; wherein the shell defines a pair of soldering pads at two opposite longitudinal ends, and each of said mounting ears defines a through hole to receive the corresponding soldering pad therein; wherein said metallic shell forms on a front edge thereof a pair of resilient arms adjacent to the corresponding soldering pads, respectively, to clip upon the metallic retaining member.

14. The electrical connector assembly as claimed in claim 13, wherein the shell defines a pair of opposite end walls at two opposite longitudinal ends, respectively, and the soldering pads extend outwardly beside the corresponding end walls, respectively.

15. The electrical connector assembly as claimed in claim 14, wherein each of said end walls is further equipped with a resilient arm extending from a front edge in a folded manner to clip the corresponding mounting ear thereto.

16. The electrical connector assembly as claimed in claim 13, wherein the shell defines a pair of guiding portions extending into the mating port, and said retaining member shield said pair of guiding portions in the vertical direction.

17. The electrical connector assembly as claimed in claim 13, wherein a strengthening arm linked between said pair of mating tongues at one longitudinal end of the gap.

18. The electrical connector assembly as claimed in claim 17, further including another strengthening arm around one end of the housing in the longitudinal direction to cooperate with said strengthening arm to commonly define the mating port.

19. The electrical connector as described in claim 1, wherein the first strengthen arm forms a wedge structure extending away from the first mating port along the longitudinal direction.

20. The electrical connector as described in claim 8, wherein the first strengthen arm forms a wedge structure extending away from the first mating port along the longitudinal direction.

* * * * *